United States Patent [19]

Nakamura et al.

[11] Patent Number: 4,710,125

[45] Date of Patent: Dec. 1, 1987

[54] SAFETY DEVICE FOR OIL BURNER

[75] Inventors: Kazuharu Nakamura; Motoki Matsumoto; Akinobu Kondo; Kiyonobu Ito, all of Aichi, Japan

[73] Assignee: Toyotomi Kogyo Co., Ltd., Aichi, Japan

[21] Appl. No.: 847,513

[22] Filed: Apr. 3, 1986

[30] Foreign Application Priority Data

Apr. 11, 1985 [JP] Japan ..... 60-77287

[51] Int. Cl.[4] ..... F23N 5/24

[52] U.S. Cl. ..... 431/22; 431/78; 126/93; 340/579; 328/6

[58] Field of Search ..... 431/78, 22; 328/6; 340/579; 126/93

[56] References Cited

U.S. PATENT DOCUMENTS 2,074,637 3/1937 Ballentine ..... 431/78
2,640,920 6/1953 Cairns ..... 328/6
3,301,307 1/1967 Nishigaki et al. ..... 340/579
4,561,840 12/1985 Nakamura et al. ..... 431/78

*Primary Examiner*—Carroll B. Dority, Jr.
*Attorney, Agent, or Firm*—Pollock, Vande Sande & Priddy

[57] ABSTRACT

A safety device for an oil burner is disclosed which is capable of carrying out the detection of flame by means of a DC flame current obtained due to the rectification of flame to detect the abnormal combustion in the oil burner. The safety device includes a first flame electrode surrounded by flame of normal combustion in the oil burner and a second flame electrode arranged away from the flame and connected to an AC voltage source in a manner to be in parallel with the first flame electrode, so that the second flame electrodes cooperates with the first flame electrode to detect a failure in the flowing of a flame current through the first flame electrode or a decrease in a flame current flowing through the first flame electrode, to thereby determine any abnormal combustion in the oil burner.

5 Claims, 5 Drawing Figures

SAFETY DEVICE FOR OIL BURNER

BACKGROUND OF THE INVENTION

1. Field of the Invention

This invention relates to a safety device for an oil burner, and more particularly to a safety device for an oil burner which is adapted to monitor combustion of the oil burner utilizing rectification due to flame formed by the combustion.

2. Description of the Prior Art

Conventionally, the detection of excessive flame due to abnormal combustion in an oil burner has been typically carried out by means of a high limit switch. This is adapted to detect abnormal rise in temperature of a heat exchanger or a frame. However, such abnormal temperature rise occurs as a result of abnormal combustion, accordingly, the prior art fails to detect starting of the abnormal combustion. In view of such a defect of the prior art, a flame detecting apparatus for detecting abnormal combustion in an oil burner was proposed, as disclosed in Japanese Utility Model Application No. 163756/1982. More particularly, the apparatus proposed is provided with two combustion flame detectors each utilizing the rectification of flame, one of which is adapted to detect flame sufficiently small to be blown out and the other is adapted to detect only excessive flame formed due to abnormal combustion.

However, the arrangement of such two flame detecting devices is highly disadvantageous from viewpoints of its structure and cost.

Accordingly, it would be highly desirable to provide a safety device for an oil burner which is capable of detecting not only small flame due to abnormal combustion but excessive flame by means of a single flame detector.

SUMMARY OF THE INVENTION

Briefly speaking, in accordance with the present invention, a safety device for an oil burner is provided which is adapted to apply an AC voltage between a first flame electrode and an oil burner to detect flame based on a DC flame current generated due to the rectification of flame between the first flame electrode and the oil burner. The first flame electrode is positioned to receive flame formed due to normal combustion in the oil burner. The safety device also includes a second flame electrode arranged at a position to which flame of the normal combustion does not reach. The second flame electrode is connected to an AC voltage source in a manner to be in parallel to the first flame electrode, so that a failure in the flowing of a flame current through the first flame electrode or a decrease in a flame current flowing through the first flame electrode may be detected to detect any abnormal combustion in the oil burner.

Accordingly, it is an object of the present invention to provide a safety device for an oil burner which is capable of detecting any abnormal combustion.

It is another object of the present invention to provide a safety device for an oil burner which is capable of detecting any abnormal combustion in the oil burner with a highly simple structure.

It is a further object of the present invention to provide a safety device for an oil burner which is capable of effectively detecting both small flame and excessive flame each formed due to abnormal combustion in the oil burner.

It is still a further object of the present invention to provide a safety device for an oil burner which is capable of accomplishing the above-described objects by means of a single flame detector including two-in-a-set electrodes.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like parts throughout; wherein.

DETAILED DESCRIPTION OF THE PREFERRED EMBODIMENT

Now, a safety device for an oil burner according to the present invention will be described hereinafter with reference to the accompanying drawings.

Figure 1:
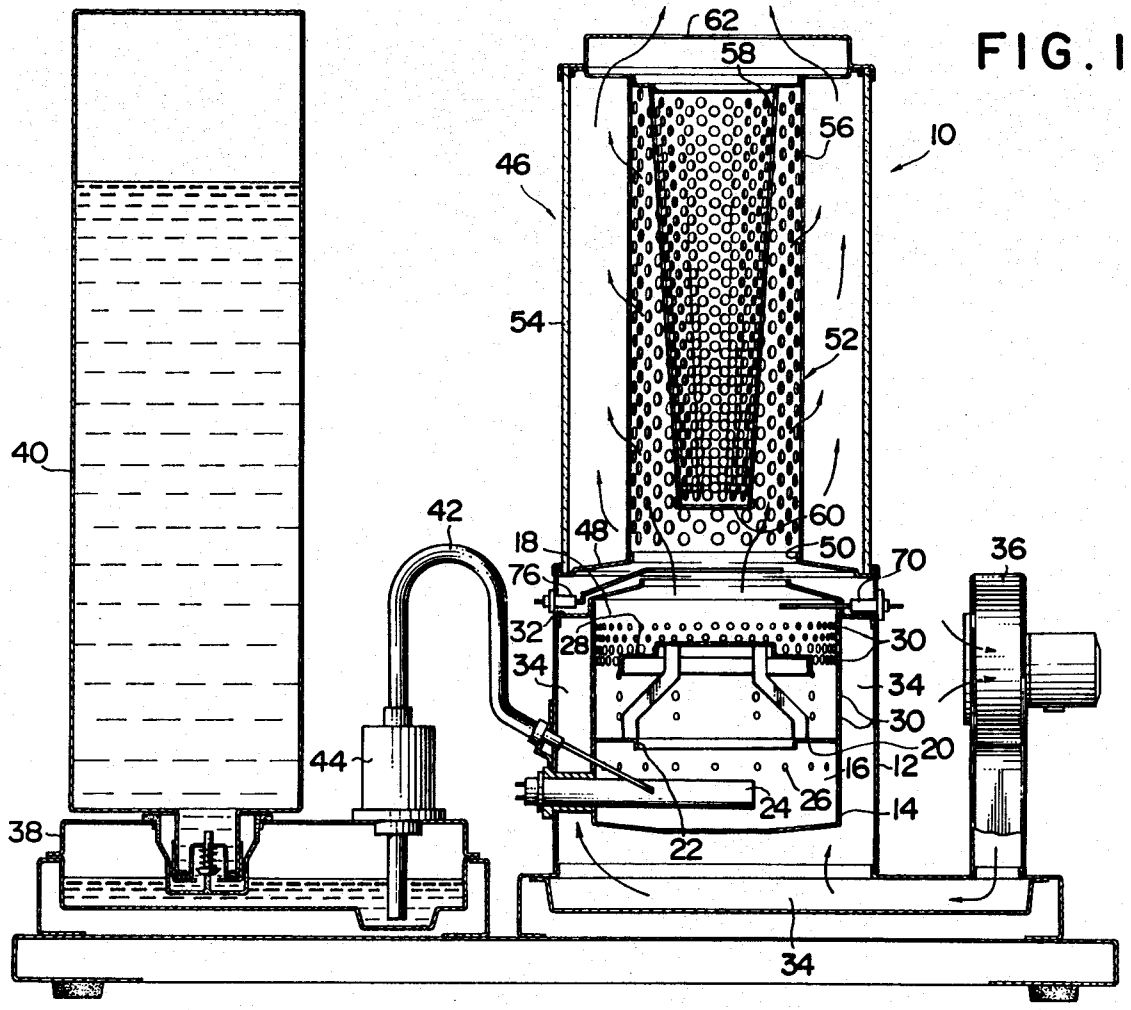
FIG. 1 is a vertical sectional view showing an example of an oil burner in which a safety device according to the present invention is adapted to be incorporated.

FIG. 1 illustrates an example of an oil burner in which a safety device according to the present invention is adapted to be incorporated. The oil burner generally designated by reference numeral 10 is in the form of a pot-type oil burner, however, it should be noted that an oil burner for which a safety device according to the present invention is to be used is not limited to such a pot-type oil burner.

The pot-type oil burner itself may be constructed in a manner known in the art. More particularly, the oil burner 10 includes a housing 12 of a substantially cylindrical shape and a pot 14 received in the housing 12. The pot 14 is adapted to carry out therein the vaporization, ignition and combustion of fuel oil such as kerosene fed thereto in such a manner as described hereinafter. For this purpose, the pot 14 has a lower chamber 16 for the vaporization and ignition of fuel oil and an upper chamber 18 for the combustion of fuel oil formed therein which are separated from each other by a horizontal partition 20. The partition 20 is formed at a central portion thereof with an opening 22 through which the upper chamber 18 is communicated with the lower chamber 16. Arranged in the lower chamber 16 is an electric heater 24 which serves to heat fuel oil fed to the pot 14 to vaporize it and ignite the so-vaporized fuel oil using air fed from through-holes 26 formed at a side wall of the lower chamber 16.

The upper chamber 18 has a plate means 28 supported on the partition 20 and positioned above the opening 22 therein, which is formed into an inverted dish shape and acts to spread flame of fuel oil ignited in the lower chamber 16 and carry out combustion of fuel oil using air fed to the chamber 18 via a plurality of through-holes 30 formed at a side wall of the upper chamber 18.

In the illustrated example, the pot 14 is suspended in the housing 12 by means of a top plate 32 of the pot 14 outwardly extending from the pot 14 to the housing 12, so that an air passage 34 may be defined between the housing 12 and the pot 14 for feeding air from an air fan 36 therethrough to the pot 14. For this purpose, the air passage 34 is communicated via the through-holes 26 and 30 of the pot with an interior thereof.

In the pot constructed as described above, flame formed due to normal combustion in the pot 14 extends to the upper end of the top plate 32 of the pot.

The pot-type oil burner 10 also includes an oil feed means for supplying fuel oil to the pot 14, which comprises an oil reservoir 38, an oil tank 40 supported on the oil reservoir 38 in an inverted manner and communicated therewith, an oil feed pipe 42, and an electromagnetic pump 44 arranged between the oil feed pipe 42 and the oil reservoir 38 to forcedly feed fuel oil through the oil feed pipe 42 to the pot 14.

Further, the oil burner 10 includes a multiple combustion cylinder construction 46 supported on a top plate 48 of the housing 12 which is formed at a central portion thereof with an opening 50 for communicating the pot 14 therethrough with the combustion cylinder construction 46. The combustion cylinder construction 46 is adapted to introduce thereto combustion gas of a high temperature sufficient to be red-heated and discharge heat rays and combustion gas therefrom to the interior of a room, to thereby efficiently heat the room.

More particularly, the multiple combustion cylinder construction 46 includes a red-heated cylinder means 52 and a heat-permeable cylinder 54 arranged to surround the cylinder means 52 with a space being defined therebetween. The cylinder means 52 comprises an outer perforated cylinder 56 and an inner perforated cylinder 58 arranged in a manner to be concentric with the outer cylinder 56 and having a bottom wall 60 attached thereto. In the multiple combustion cylinder construction 46, heat due to combustion in the pot 14, particularly, in the upper chamber 18 renders the cylinders 56 and 58 red-heated to a degree sufficient to outwardly emit heat rays therefrom through the heatpermeable cylinder 54, and combustion gas due to the combustion is upwardly discharged from the construction 46 through an opening 62 formed at a top of the construction 46 to the interior of a room.

Figure 2:
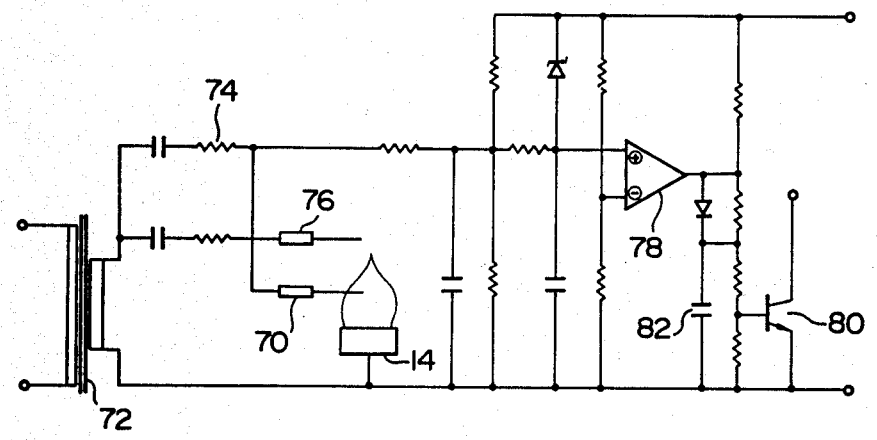
FIG. 2 is a circuit diagram showing one example of an electrical circuit of a safety device according to the present invention.

A safety device according to the present invention which is incorporated in the oil burner described above, as shown in FIG. 1, includes a first flame electrode 70 arranged at the upper portion of the pot 14 or the upper chamber 18 so as to be constantly positioned in or surrounded by combustion flame formed therein during the normal combustion operation of the oil burner 10. The first flame electrode 70 may be formed into any suitable shape such as a rod-like shape and is electrically insulated from the pot 14. As shown in FIG. 2, between the first flame electrode 70 and the pot 14 is applied an AC voltage induced across a secondary winding of a transformer 72 connected to a commercial AC power source (not shown). The first flame electrode 70 to which an AC voltage has been applied causes a DC flame current to flow therethrough when it is surrounded by flame formed due to combustion in the pot; because the resistance of the flame from the electrode 70 to the pot is low, whereas that from the pot to the electrode is high. The so-generated DC current may be detected by means of a DC ammeter as shown in FIG. 3. The obtained DC current actually is hard to be utilized; accordingly, in the embodiment illustrated, the flame electrode has a resistor 74 connected thereto. This permits a voltage induced across the resistor 74 to be observed when the flame current flows through the first flame electrode 70, so that the magnitude of the flame current may be readily detected.

The safety device of the illustrated embodiment also includes a second flame electrode 76. The second flame electrode 76, as shown in FIG. 1, is supported by the housing 12 so as to be spaced from the first flame electrode 12 and positioned in or in proximity to the opening 50 of the housing 12, so that it may be prevented from being affected by flame formed due to normal combustion in the pot 14. The second flame electrode 76 is connected to the AC voltage source 72 in a manner to be in parallel to the first flame electrode 70 as shown in FIG. 2. The second flame electrode 76 may be formed into any suitable shape such as a rod-like shape, an annular shape or the like.

In FIG. 2, reference numeral 78 designates a comparator for carrying out the comparison between a reference voltage and a voltage obtained from a flame current, 80 indicates a transistor controlled by an output of the comparator 78 and 82 indicates a capacitor which serves to prevent the transistor 80 from immediately following the comparator 78 when the output of the comparator 78 is varied due to flickering of combustion flame.

Now, the manner of operation of the safety device of the illustrated embodiment described will be described hereinafter with reference to FIGS. 2 and 3.

Figure 3A:
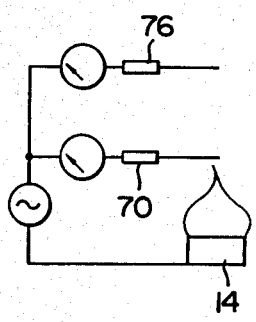
FIGS. 3A, 3B and 3C each are a schematic view showing the operation of a safety device according to the present invention.
Figure 3B:
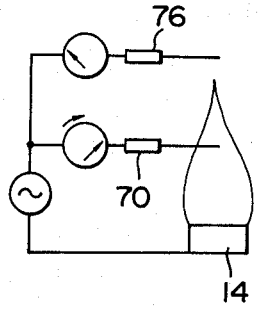
Figure 3C:
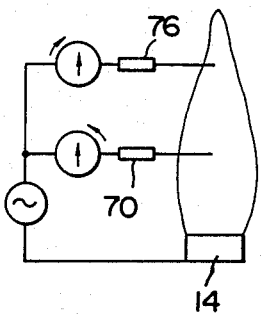

When flame formed in the pot 14 is decreased for the reason of immediately after the ignition or due to the abnormal combustion as shown in FIG. 3A, a significant flame current fails to flow through the first flame electrode 70. This results in the safety device making the determination of flame absence. When normal combustion takes place in the pot 14 to form normal flame sufficient to surround the first flame electrode 70 but insufficient to reach the second flame electrode 76 as shown in FIG. 3B, an AC voltage applied to the first and second flame electrodes 70 and 76 causes a flame current to flow through the first flame electrode 70 and causes no flame current to flow through the second flame electrode 76 or fails to flow any significant flame current through the second flame electrode 76. This results in the safety device making the determination of flame presence. Further, when excessive flame is formed due to abnormal combustion in the pot 14 which is sufficient to reach the second flame electrode 76 as well as the first one 70 as shown in FIG. 3C, a flame current is caused to flow through each of the electrodes 70 and 76. This results in the total flame current obtained due to the application of an AC voltage being somewhat increased. However, the flame current is distributed to the second flame electrode 76 as well as the first one 70, resulting in the equalization of the flame current. Accordingly, the flame current flowing through the first flame electrode 70 is substantially decreased, as compared with that shown in FIG. 3B, to a degree sufficient to cause the safety device to make the determination of flame absence.

As can be seen from the foregoing, the present invention is constructed in the manner that the second flame electrode is added to the flame detecting circuit including the first flame electrode so that the circuit may the determination of flame absence when flame is both small and excessive. Thus, the present invention can effectively detect abnormal combustion causing excessive flame as well as too small flame with a significantly simple structure.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A safety device for an oil burner comprising:

a first flame electrode arranged at a position to be exposed to flame formed due to normal combustin in said oil burner;

means for applying an AC voltage between said first flame electrode and said oil burner so that normal combustion in said oil burner may be detected when a DC flame current flows through said first flame electrode due to the rectification of flame carried out between said first flame electrode and said oil burner;

a second flame electrode arranged at a position to which flame of said normal combustion in said oil burner does not reach, said means for applying an AC voltae including circuit means for providing a single source of current to said first and second electrodes and dividing current from said single source between said first and second flame electrodes when said second electrode is reached by an excessive flame;

detection means for detecting abnormal combustion due to either a failure in the flowing of said flame current through said first flame electrode when said flame is too small, or a decrease in said flame current flowing through said first flame electrode because of said division of current between said first and second flame electrodes when said flame is excessive.

2. A safety device for an oil burner as defined in claim 1, wherein said first flame electrode has a resistor connected thereto so that a voltage between the connection of said first flame electrode with said resistor and said oil burner may be monitored to detect said flame current.

3. A safety device as defined in claim 1, wherein said first electrode is positioned at an upper portion of a pot of said oil burner and said second flame electrode is arranged at a position upwardly spaced from said pot.

4. A safety device as defined in claim 1, wherein said first electrode has a rod-like shape and said second flame electrode has an annular shape.

5. A safety device as defined in claim 1, wherein said first and second flame electrodes each have a rod-like shape.

* * * * *

UNITED STATES PATENT AND TRADEMARK OFFICE

CERTIFICATE OF CORRECTION

PATENT NO. : 4,710,125

DATED : December 1, 1987

INVENTOR(S) : Nakamura, et al.

It is certified that error appears in the above-identified patent and that said Letters Patent is hereby corrected as shown below:

In claim 1, line 3, change "combustin" to --combustion--.

Signed and Sealed this

Third Day of May, 1988

*Attest:*

*Attesting Officer*

DONALD J. QUIGG

*Commissioner of Patents and Trademarks*